United States Patent [19]

Medynski et al.

[11] 4,029,032

[45] June 14, 1977

[54] TIE SEWING MACHINE

[76] Inventors: Joseph M. Medynski, 18 Park St., Ramsey, N.J. 07446; John B. Medynski, 680 Knollwood Road, Franklin Lakes, N.J. 07417

[22] Filed: May 13, 1976

[21] Appl. No.: 686,171

[52] U.S. Cl. ..... 112/121.22; 112/121.26; 112/152

[51] Int. Cl.[2] ..... D05B 23/00

[58] Field of Search ..... 112/121.22, 121.26, 112/121.29, 152, 136

[56] References Cited

UNITED STATES PATENTS

| | | | |
|---|---|---|---|
| 2,231,648 | 2/1941 | Weis | 112/121.26 |
| 2,275,457 | 3/1942 | Newman | 112/121.22 X |
| 3,443,532 | 5/1969 | Posey et al. | 112/121.26 |
| 3,745,949 | 7/1973 | Medynski | 112/152 |

*Primary Examiner*—H. Hampton Hunter

[57] ABSTRACT

In a preferred embodiment, a tie-stitching machine includes paired needles conventionally drivable axially to and fro through respective holes therefor aligned therewith in a planar upper surface of a flat base plate devoid of claws and any mounting opening therefor, and having instead a drivably mounted roller aligned behind the sewing needles and foot, biased downwardly and forwardly angularly on a pivotedly mounted roller-mounting structure mounted on the main support structure and spring biased by a spring, driven drivably through a slip clutch in-turn driven by to and fro motion taken from a lever mounted eccentrically on the main drive shaft, and there being a manual lever for lifting concurrently each of the roller and the foot, and another automatic lever for lifting the foot prior to and during driving rotation of the mounted roller, and for depressing the foot during the alternate sewing phase.

8 Claims, 7 Drawing Figures

FIG.4
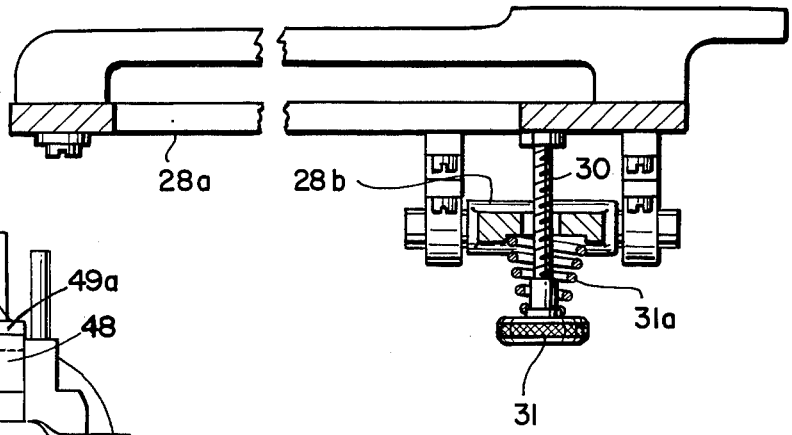
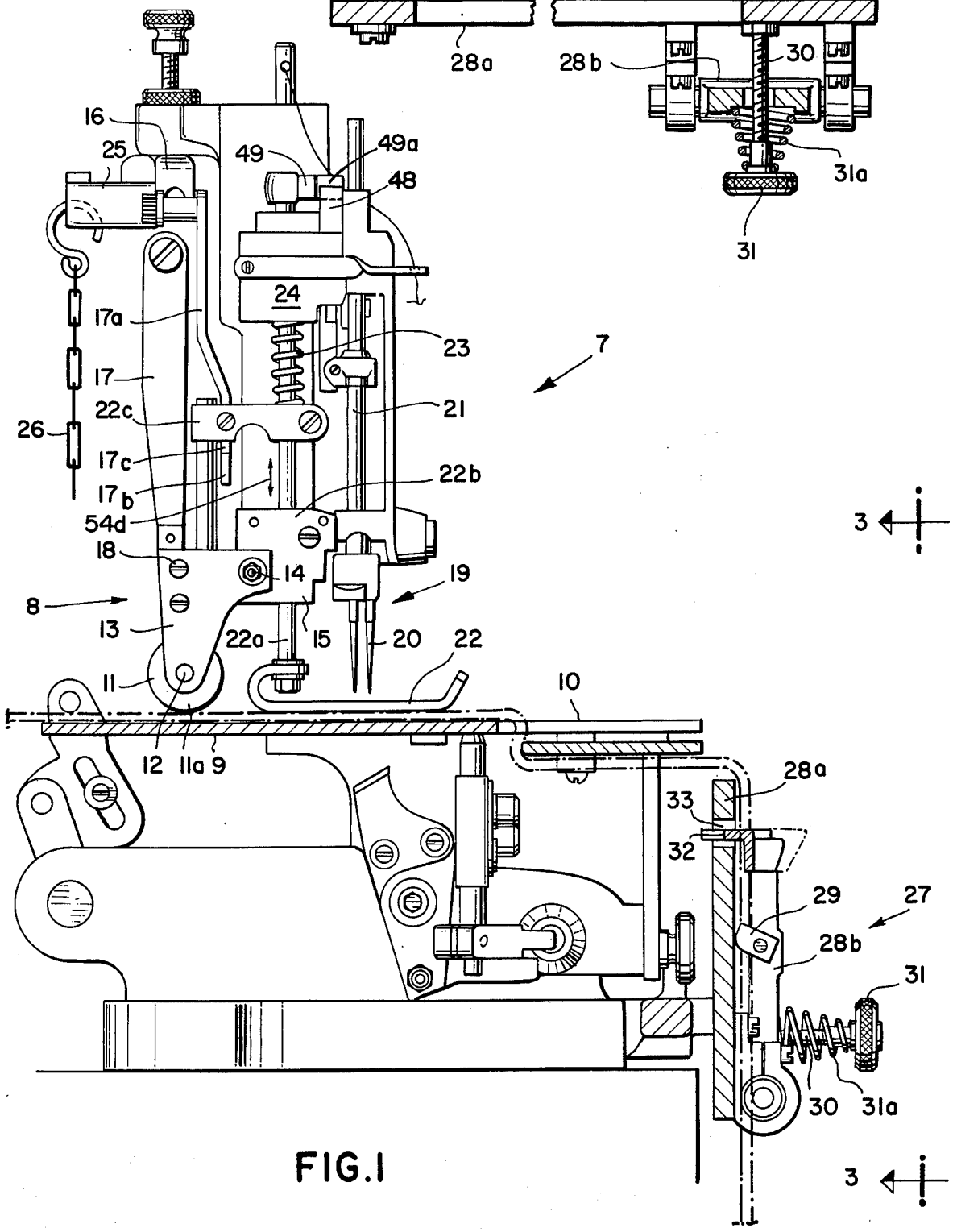
FIG.1

FIG. 5
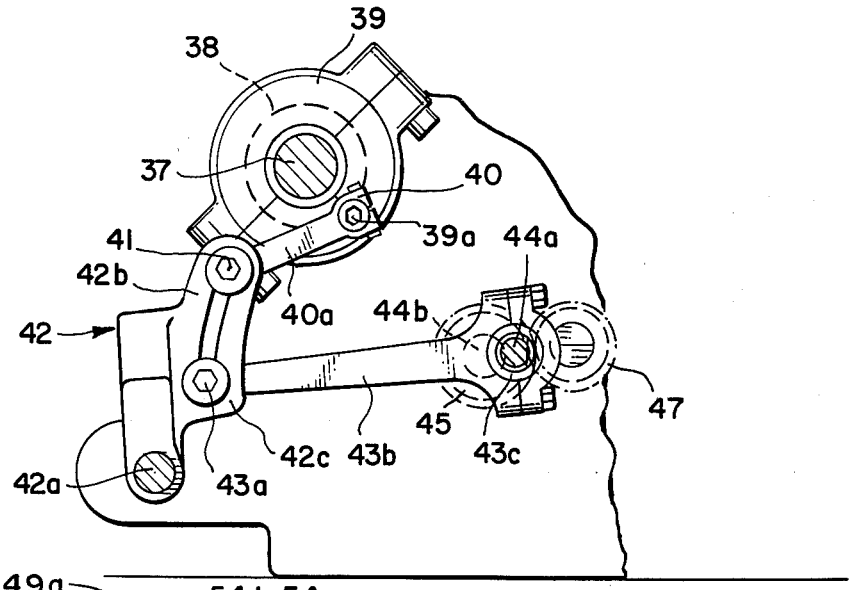
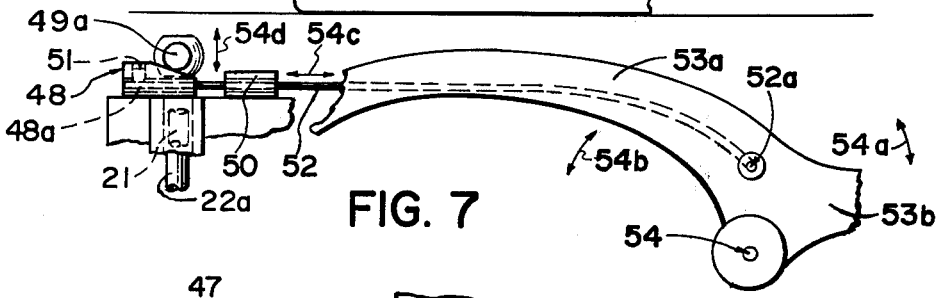
FIG. 7
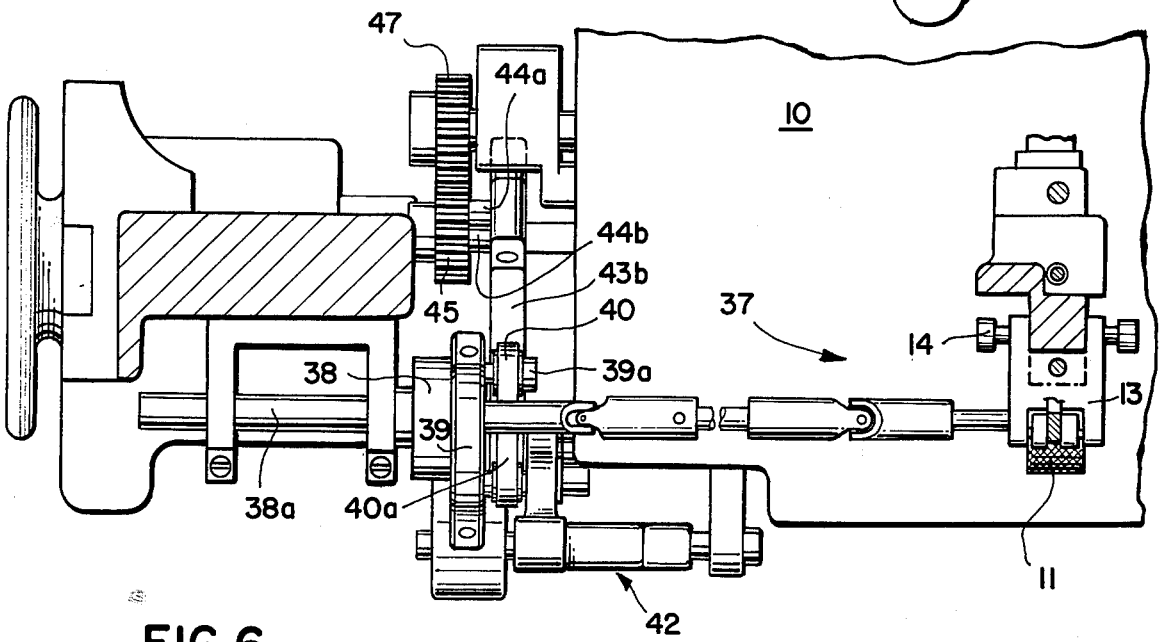
FIG. 6

TIE SEWING MACHINE

This invention relates to a tie-stitching sewing machine, to a mechanism for advancing the tie and avoiding wrinkle problems.

BACKGROUND TO THE INVENTION

Prior to the invention, tie stitching machines have commonly had conventional advancing claws embodied within cut-away space in a flat base plate over which tie material is advanced forwardly to rearwardly beneath needle position(s) and the foot. There has been a major problem in bringing about smooth advancing of tie fabrics to be sewn devoid of twisting or wrinkling, even with best operator efforts guiding the fabric.

SUMMARY OF THE INVENTION

Accordingly, objects of the present invention include overcoming the problem together with obtaining novel advantages.

More particularly, an object is to obtain an advancing mechanism other than heretofore advancing-claws, devoid of the problem.

Another object is to obtain a slip-clutch type drive-advancing coordinated with lifting of the foot prior to and during drive.

Another object is to obtain a fabric-release device for relieving pressure of the advancing, and of the foot during mounting, advancing, and dismounting of tie fabric.

Other objects become apparent from preceding and following disclosure.

Objects are obtained by the invention illustrated herein.

Broadly the invention may be defined as a sewing machine, preferably of the tie-stitching type, having the conventional flat base plate with its upper planar surface, but devoid of cut-away for advancing claws, and having otherwise the typical one or more needle holes for single or double needles respectively, and conventional needle(s) mounted for axial movement(s) thereof to and fro upwardly and downwardly through the respective hole(s) below the needle end(s) or point(s), and a fabric-advancing roller means positioned behind the needle(s) and foot/feet, within the lower surface of the roller being biased both downwardly and angularly forwardly by virtue of the mounting of the roller on an end of a springbiased pivoted arm, together with the roller being driven by a drive and gear mechanism adapted to intermittently drive by a drive and gear mechanism adapted to intermittently drive a lower surface of the roller from forwardly to rearwardly while concurrently a lever automatically lifts the foot prior to and during the driven rotation of the roller and automatically depresses the foot subsequently and during the alternating sewing (stitching) phase, thereby effecting advancing of the tie fabric between preceding and the following stitches being imparted to the fabric. The angular downward pressure of the roller has been found to be critical to the successful operation of this machine, mere vertical biasing downward pressure of a roller having been found by the inventor not to be operative nor the equivalent to the angularly directed pressure, the term angularly being intended to encompass an angle ranging from about 23° to substantially 68°, as measured from a horizontal of the planar upper surface of the flat base plate. In a preferred embodiment, this is achieved by the roller being substantially horizontally mounted with respect to the axis around which rotation takes place, with the supporting axis being mounted on the end of a pivoted arm pivotably mounted on the main support structure such that in the arc of pivot, the arc intercepts the planar upper surface of the flat base plate at the angle described above, as the roller is in the arc biased forwardly and downwardly. The invention critically also includes, however, a forwardly-positioned and mounted feedmaterial guide mechanism-structure(s), which guides the feed-material from a predetermined forward point of feed to rearwardly along a linear path toward the needle hole and toward the fabric-advancing roller as well as it simultaneously, while guiding, also placing a predetermined restraining torque or tension on the feed-material; the feed-material guide mechanism-structure(s) includes a biasing spring in-effect clamping together opposing jaws between which the feed-material is threaded, with one face of one of the jaws being so-shaped and positioned such that restraining torque on a narrower portion of the feed-material is lesser than restraining torque at a different time on a wider portion of the feed-material axially along the length of the feed-material. In a preferred embodiment thereof, for the feed-material guide mechanism-structure(s), the shaped face is recessed, preferably in a concave manner centrally of the face. In a further preferred embodiment thereof, central of the concave portion there is a further-recessed notch such that free-travel devoid of any restraining torque is achieved whenever the feed-material's width becomes equal to or less than the width of the notch, during the feeding-advancing of the feed-material.

The driving mechanism is by way of a driving cycle of a slip-clutch which in turn receives its driving force from an eccentrically mounted lever eccentrically mounted on and around the main drive shaft. The sewing action of the needle(s) is/are conventionally also driven by an eccentrically mounted lever. The timing is set such that the driving roller is in its intermittent driving phase solely during the period that the needle(s) is/are in the up and withdrawn position(s) between consecutive stitches. Also preferably there is manually operable lever(s) connected to each of downwardly spring-biased foot (feet) and the downwardly biased roller, adapted such that a lifting force may lift the foot (feet) and roller during which tie fabric or other feed-material, may be inserted beneath the same, or removed from beneath the same. A light lifting pressure or force serves to lift the roller surface, while a greater pressure of force lifts higher the roller surface and concurrently engages with the downwardly-biased foot(feet)-mountings to thereby lift the foot (feet). A stop limits degree of closing of the restraining jaws.

THE FIGURES

FIG. 1 illustrates a side and in-part cross-sectional view of a preferred embodiment of the sewing machine of the invention.

FIG. 4 illustrates an elevation and in-part cross-sectional view as taken along lines 4—4 of FIG. 3.

FIG. 5 illustrates an in-part and side view of drive, slip-clutch and gearing by which driving of the fabric-advancing roller is achieved, intermittently.

FIG. 6 illustrates an elevation and in-part cross-sectional view of the drive, slip-clutch and gearing of FIG. 5, for improved understanding of the driving mechanism.

FIG. 7 illustrates an in-part and elevation front view.

DETAILED DESCRIPTION

Figure 2:
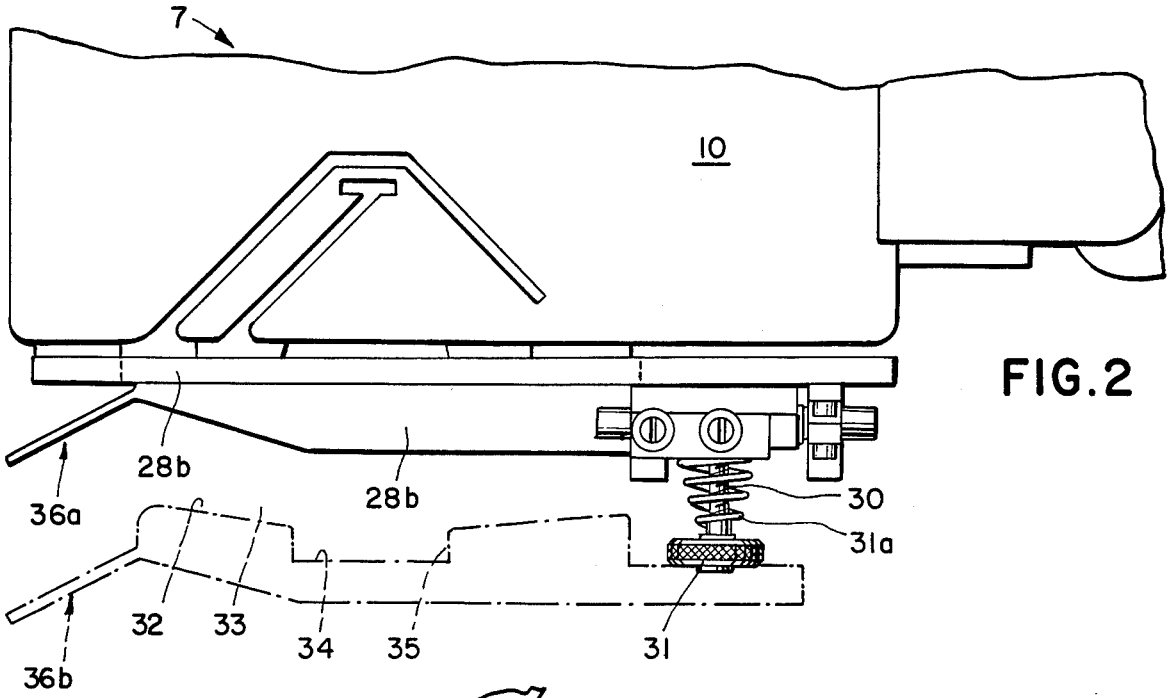
FIG. 2 illustrates an elevation plan view, in an in-part view, as taken along lines 2—2 of FIG. 1.
Figure 3:
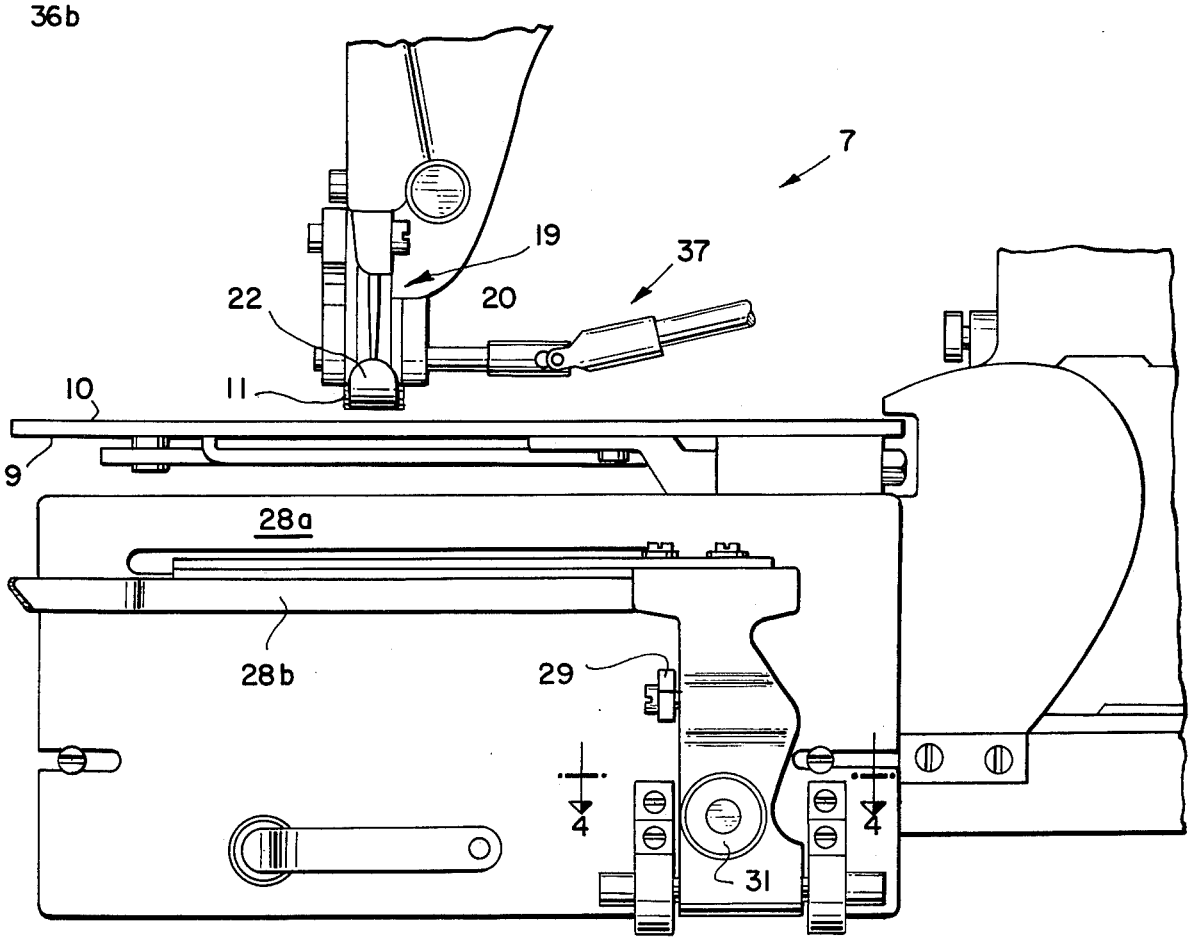
FIG. 3 illustrates a front elevation view as taken along lines 3–3 of FIG. 1, in an in-part view.

While the illustrations herein are not limiting of obvious scope of the invention to varying embodiments thereof, the FIGS. 1 through 6 illustrate a more preferred embodiment thereof, described in detail as follows.

The description flows substantially from FIG. 1 consecutively through the FIG. 6, but is not specifically limited thereto since the elements described are viewable in differing views as shown in the several figures.

In particular, the preferred machine is shown in side view and in partial cross-section as machine 7 of FIG. 1, with a rearwardly located fabric-advancing roller mechanism (and structure(s) thereof) 8 pressing downwardly and slightly forwardly onto a plate (base plate) 9 upon the upper face 10 thereof by the roller surface 11, of roller 11*a*. The roller 11*a* is drivably mounted on shaft 12 onto pivot structure 13 pivotably mounted by mounting pin 14, mounted in conventional support structure 15. The pivot structure 13 is held in a biased downwardly position and state of predetermined but adjustable tension, by the pressure of biasing leaf spring 16 pressing downwardly through the arm 17 connected by pin 18 to the pivot structure 13. The interconnected lever 17*a* also is moved downwardly concurrently with downward movement of the arm 17; lever arm end 17*b* is stepped to extend beneath the element 22*c* with a predetermined amount of free-play space 17*c* such that upon downward movement of chain 26, lever 25 is turned to cause arm 17 and lever 17*a* and lever end 17*c* to all move upwardly counter to biasing action of the leaf spring 16, and when the key of the stepped end 17*c* engages with the lower face of the element 22*c*, the foot 22 is caused to be lifted from its downwardly biased position. Foot 22 is carried by shaft 22*a* which in turn is attached to each of elements 22*b* and 22*c*, these two latter elements being slidable upwardly by the pulling downwardly of chain 26 to move the element 22*c* upwardly against downwardly biasing action of spring 23 which is biased between mounting structure 24 and the element 22*c*.

The guide and restraining structures 27 include a forward jaw-plate 28*b* and a rearward stationary jaw plate 28*a*, with an adjustable stop 29 for regulating the degree of maximum closing of the jaw plates toward one-another, the jaw plate structure 28*b* being pivotably mounted at its lower end and spring-biased rearwardly (toward a closing position) by spring 31*a* mounted between adjustable nut-element 31 (adjustable of the degree of pressure) and the jaw plate structure 28*b*. The stop 29 is mounted on the jaw plate structure 28*b*. (but could alternately be mounted as easily on the jaw plate 28*a*). An important feature of the present invention is the recessedly sloped front edge 32 of the jaw plate structure 28*b*, preferably concave by recessed slopes at each of opposite ends of the face 32 centrally thereof with preferably a stepped structure 34 centrally, defining space 33 by the slopes of faces 32 and space 35 by the stepped structure 34. For extension structure of the jaw plate 28*b*, an opened state (as when held open by an operator during mounting of a fabric feed-material) is shown at state 36*b*, and a closed position at state 36*a* in FIG. 2.

The roller 11*a* is driven by the revolving drive shaft (of several links) 37 which extends from the slip clutch 38 through the drive plate 39 driven by shaft 40*a* mounted on pin 39*a* by ring structure 40, and on 41 of lever portion 42*b* of lever 42 which pivots on pin 42*a*, with a driving lever 43*b* mounted by pin 43*a* at lever portion 42*c*, and at an opposite end mounted by ring portion 43*c* on eccentric shaft portion 44*a* of shaft 44*b*. The sewing machine is conventionally driven by the gear 47 which is in turn driven by the gear 45 of shaft 44*a*.

Accordingly, the roller 11*a* is driven intermittently by action of the slip clutch 38 with the driving action predetermined coordinated with the up-position of the needle(s) during the stitching thereby. The driven roller surface 11 serves to place the exact advancing pull on an upper surface of fabric feed-material in order to advance land stretch-slightly the same which is caused thereby to slip with some difficulty and torque (tension) because of retaining and/or restraining pressure exerted by the jaw plates 28*a* and 28*b* through which the fabric feed-material is fed.

This inventive machine is with specificity directed to the problems encountered in the sewing of tie material and lining thereof. Accordingly, while when the wider first-fed portion of the tie requires a greater amount of stretching in order to prevent wrinkles during and/or after the stitching, the situation is substantially reversed as the portions of the tie being sewn become smaller and smaller (narrower and narrower) — the difficulty arising if the tensioning remains too great. Accordingly, the sloped and concave portions of the face 32 cause the gripping upon the fabric feed-material to be less as the width becomes less, and finally the restraining torque becomes zero for free-feed when the tie material has been advanced sufficiently for the width to become equal to or less than the width of the gap of the stepped structure 34 defining the free-feed space 35.

The foot is lifted intermittently by shaft 22*a* being lifted when cam(wedge) 48 is pulled beneath roller 49*a* mounted on head 49. FIG. 7 best illustrates rod 52 extending from cam 48 through guide 50 to anchor on lever arm 53*a* at hole 52*a*. The lever arm 53*a* pivots on pin 54 and moves upwardly when lever arm 53 (driven by the conventional machine) moves downwardly, to thereby cause the cam to lift roller 49*a* and head 49. Thus, when lever arms 53*a* and *b* move in directions 54*a* and *b*, rod 52 moves in directions 54*c*, and roller 49*a* moves in directions 54*d*. The cam 48 is adjustable and locked onto rod 52 by lock-screw 47 within space 48*a* of cam 48.

Thus, the proper functioning of the invention arises from the particular direction of pivot of the advancing roller 11*a* during critical release of foot pressure, in conjunction with the degree of restraining pressure and thus stretching torque resulting from the feed guide and retaining structures as jaws 28*a* and 28*b*.

It is within the scope of the invention to modify and substitute equivalents as would be apparent to a person skilled in this field.

I claim:

1. A sewing machine comprising in combination: a substantially flat base plate having a substantially planar upper surface with at least one needle hole therein;

needle means for aligning a needle with said needle hole and for sewing feed-material passed along said planar upper surface over said needle hole beneath a needle end of said needle; fabric-advancing roller means for providing a roller surface; means biasing said roller surface angularly forwardly toward said needle means and downwardly toward said planar upper surface; a presser foot drive and gear means for driving the needle axially along a longitudinal axis in directions in said needle hole and for lifting said pressure foot intermittently and for concurrently driving rotatably said roller surface of the roller means advancingly of a lower surface of the roller surface in a direction away from said needle hole, the lower surface of said roller being advanceable of said feed-material rearwardly during a phase in which the needle and foot are spaced-above the needle hole such that the feed-material is advanceable beneath the needle end; feed-material guide means for guiding the feed-material from a predetermined forward point rearwardly along a linear path toward said needle hole and said fabric-advancing means, and for placing a predetermined restraining torque on the feed-material, the feed-material guide means including spring-biased structure having a pressure-applying face shaped and positioned such that said restraining torque is lesser for a narrow width than for a wide width at differing points axially along and of said feed-material; and the flat base plate, the needle means, the fabric-advancing roller means, the drive and gear means, and the feed-material guide means being mounted in fixed relationships to one-another.

2. A sewing machine of claim 1, in which said pressure-applying face has a recessed portion.

3. A sewing machine of claim 2, in which said recessed portion is substantially concave, and includes a central notch.

4. A sewing machine of claim 3, in which said drive and gear means includes a main drive shaft and a first lever element having one end thereof mounted eccentrically around the main drive shaft and having an opposite other end thereof mounted pivotably around a pivot pin, and the pivot pin mounted with other lever structure and with a slip-clutch means for and adapted to drive responsive to one of to and fro axial movement of the first lever element as driven by virtue of the eccentric mounting thereof when the main drive shaft rotates and to slip during the other of the to and fro movement of the first lever element; and a secondary drive shaft mounted on said slip clutch means, adapted to be intermittently driven in a single rotary direction by the slip-clutch means during driving phases thereof, and the secondary drive shaft being drivably connected to the roller means operatively.

5. A sewing machine of claim 4, including as a part of said drive and gear means a second lever element as driven by virtue of eccentric mounting thereof around said main drive shaft at one end thereof, adapted to impart said directions to and fro upwardly and downwardly of the needle of the needle means.

6. A sewing machine of claim 5, in which said fabric-advancing roller means includes a roller and a roller-mounting structure rotatably mounting the roller around an axis extending substantially parallel to said planar upper surface; a support structure pivotably mounting a distal portion of the roller-mounting structure, at a point spaced-away from the roller, pivotably on said support structure; said roller means further including spring biasing means for said biasing of said lower surface, said lower surface being a circumscribing part of said roller around said axis.

7. A sewing machine of claim 6, including lift means for intermittently lifting the foot and said roller by force applied in a direction opposite to a direction of said biasing.

8. A sewing machine of claim 1, in which said fabric-advancing roller means includes a roller and a roller-mounting structure rotatably mounting the roller around an axis extending substantially parallel to said planar upper surface; a support structure pivotably mounting a distal portion of the roller-mounting structure, at a point spaced-away from the roller, pivotably on said support structure; said roller means further including spring biasing means for said biasing of said lower surface, said lower surface being a circumscribing part of said roller around said axis.

* * * * *